US005671702A

United States Patent [19]

Lindblad

[11] Patent Number: 5,671,702

[45] Date of Patent: Sep. 30, 1997

[54] VALVE SYSTEM IN A ROTARY RADIAL-PISTON ENGINE

[75] Inventor: Karl-Erik Lindblad, Alingsås, Sweden

[73] Assignee: Kesol Production AB, Alingsas, Sweden

[21] Appl. No.: 693,066

[22] PCT Filed: Feb. 14, 1995

[86] PCT No.: PCT/SE95/00149

§ 371 Date: Aug. 16, 1996

§ 102(e) Date: Aug. 16, 1996

[87] PCT Pub. No.: WO95/22689

PCT Pub. Date: Aug. 24, 1995

[30] Foreign Application Priority Data

Feb. 17, 1994 [SE] Sweden ..... 9400536

[51] Int. Cl.[6] ..... F02B 57/00

[52] U.S. Cl. ..... 123/44 D; 123/44 E; 123/54.2

[58] Field of Search ..... 123/44 B, 44 C, 123/44 D, 44 E, 54.2

[56] References Cited

U.S. PATENT DOCUMENTS

| | | | |
|---|---|---|---|
| 3,604,406 | 9/1971 | Hottelet | 123/44 E |
| 3,822,681 | 7/1974 | Townsend | 123/44 E |
| 3,828,740 | 8/1974 | Townsend | 123/44 E |
| 3,857,372 | 12/1974 | Townsend | 123/44 E |
| 3,874,348 | 4/1975 | Townsend | 123/44 B |
| 3,885,533 | 5/1975 | Townsend | 123/44 E |
| 3,967,599 | 7/1976 | Townsend | 123/44 D |
| 4,003,351 | 1/1977 | Gunther | 123/44 E |
| 4,112,881 | 9/1978 | Townsend | 123/44 D |
| 4,653,438 | 3/1987 | Russell | 123/44 E |
| 5,375,564 | 12/1994 | Gail | 123/44 D |

FOREIGN PATENT DOCUMENTS

| | | |
|---|---|---|
| 397840 | 6/1924 | Germany . |
| 385946 | 7/1976 | Sweden . |
| 90/04709 | 3/1990 | WIPO . |

*Primary Examiner*—David A. Okonsky
*Attorney, Agent, or Firm*—Dvorak & Orum

[57] ABSTRACT

On the rotary drive shaft (10) of a four-stroke engine is non-rotationally mounted a hub (11) supporting four cylinders (14) wherein pistons (16) are arranged for reciprocal movement radially towards the hub. The hub (11) is provided with a combustion chamber (25) having common inlets and outlets (26, 27) formed in a valve ring (28) rotating together with the hub (11) and sealingly abutting against a stationary port ring (30) having intake and exhaust ports (36, 37) communicating with inlet and outlet channels (34, 35) arranged alternately to assume a position in registry with the inlets and outlets (26, 27) associated with the respective combustion chamber (25). One spark plug (46) for each combustion chamber (25) is arranged to rotate with the hub (11) with the spark plug electrode end projecting into the associated combustion chamber opposite the common valve ring inlets and outlets (26, 27).

7 Claims, 8 Drawing Sheets

VALVE SYSTEM IN A ROTARY RADIAL-PISTON ENGINE

The subject invention concerns a valve system in accordance with the preamble of claim 1.

In SE-C-8803791-6 is described a four-stroke radial piston engine comprising a stationary housing, a drive shaft which is rotationally mounted essentially centrally inside said housing and which supports a hub rotating therewith, radially projecting cylinders which are mounted on the hub to co-rotate therewith, said cylinders being positioned inside a circumferentially extending chamber in said housing and each cylinder having a piston which is mounted for radial reciprocating movement inside its associated cylinder, the piston heads of said pistons facing radially inwards towards the hub, a circumferentially extending cam member mounted inside the housing in alignment with the pistons adjacent the radially outwardly extending piston ends and having a cam face facing said pistons, against which cam face abut bearing means mounted on each piston in order to impart a radial movement to said pistons in the direction towards the hub upon rotation relatively to the stationary housing of the rotary unit formed by the pistons, the cylinders, the hub, and the drive shaft, and a combustion chamber formed in said hub essentially in alignment with the head of each one of said pistons, which combustion chamber has valve-operated inlets and outlets for intake and exhaustion, respectively, of a combustion fuel-air mixture and combusted exhaust gases, whereby said pistons are imparted a radial motion away from the hub in response to the compression-induced increase of pressure and the centrifugal force, said inlets and the outlets to and from, respectively, each combustion chamber being formed in a valve ring which co-rotates with the hub and which is essentially concentric therewith, said valve ring sealingly abutting against a stationary port ring which is essentially concentric with the valve ring and which is connected to the housing, said port ring being formed with axial intake and exhaust ports communicating with inlet and outlet ducts, said axial intake and exhaust ports assuming, upon rotation of said rotary unit relatively to the housing, a position in alignment with that inlet and outlet formed in the valve ring that is associated with the respective combustion chamber, whereby the valve ring is yieldingly pressed into abutment against the port-ring.

In valve systems of this kind it has been found that medium flowing through the ports has a tendency to seep or leak into the plane of contact or junction between the valve ring and the port ring.

The main purpose of the invention is to further develop the valve device in such a manner that this drawback will be eliminated. This problem is solved in accordance with the teachings of the invention in that at least one of the two faces in sliding contact with each other on respectively the valve ring and the port ring is provided with recesses that are distributed across said face.

The invention will be described in closer detail in the following with reference to the accompanying drawings, illustrating an embodiment thereof which is particularly preferred at the moment. In the drawings, FIG. 1 is a longitudinal sectional median view through a prior-art engine.

Figure 1:
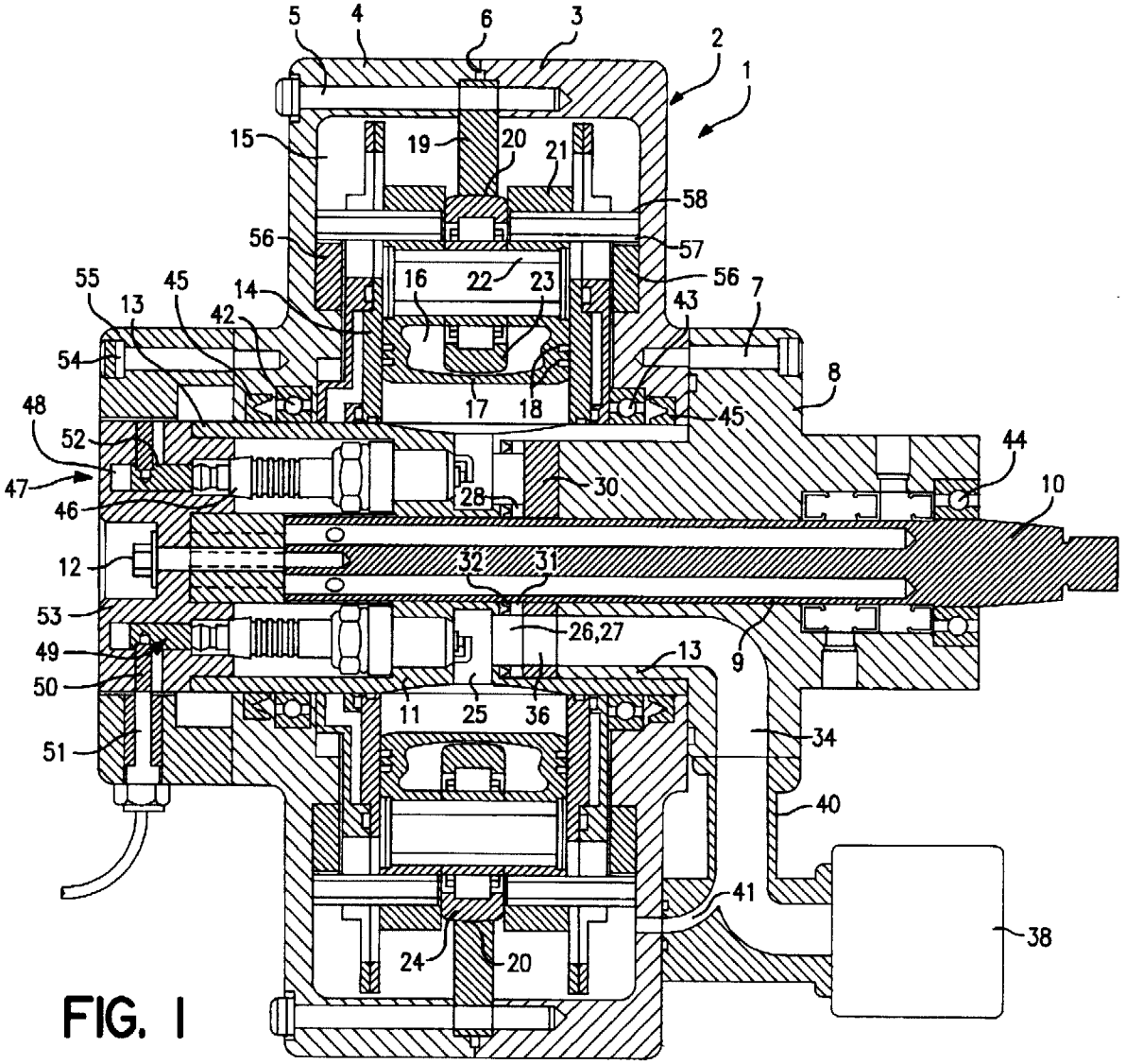

The engine illustrated in the drawings is a four-stroke internal combustion engine pertaining to the group of multiple cylinder radial-piston engines. The internal combustion engine is indicated generally by numeral reference 1 and it comprises a stationary, essentially rotationally symmetrical or annular housing 2. The stationary housing 2 is made from a suitable material, such as cast iron or light metal and it consist of two halves or housing parts 3 and 4, which are held together by means of bolts 5 spaced circumferentially adjacent the external periphery of the housing. To seal off the two housing parts 3, 4 from one another a peripheral seal 6, such as an O-ring, preferably is provided.

On one of the parts of the stationary housing 2, in accordance with the shown embodiment housing part 3, is by means of bolts 7 securely anchored a connecting collar 8 having a central through-opening 9 for reception therein of a drive shaft 10 which is mounted for rotary motion essentially in the centre of the housing 2. A hub 11 which co-rotates with the drive shaft 10 is secured on the drive shaft by means of a centre bolt 12 and is formed with axially extending, sleeve-like extensions 13.

The rotary unit formed by the drive shaft 10, the hub 11, the cylinders 14, and the pistons 16 is rotationally mounted inside the stationary housing 2 and in the connecting collar 8 by means of roller bearings 42, 43, 44, two of said bearings, viz. bearings 42, 43, being positioned between the sleeve-like extensions 13 of the hub 11 and the stationary housing 2 whereas the third bearing 44 is positioned between the drive shaft 10 and the connecting collar 8 adjacent the free projecting end of the shaft 10 to which end a power take-off means may be connected. The bearings 42, 43 may be provided with suitable seal rings 45 positioned axially externally thereof.

Radially projecting cylinders 14, of which four are provided in accordance with the embodiment illustrated in the drawings, are non-rotationally mounted on the hub 11 so as to rotate together with the latter. All cylinders 14 are positioned inside a circumferentially extending chamber 15 in the stationary housing 2, i.e. a chamber defined by housing parts 3 and 4. Each cylinder 14 receives its associated piston 16 for reciprocating movement radially therein, said pistons 16 being of an essentially conventional configuration including piston heads 17 and sealing rings 18, the piston heads facing radially inwards, towards the hub 11.

A circumferentially extending cam member 19 the cam face 20 of which faces the pistons 16 is mounted inside the stationary housing 2 opposite the pistons 16 at the radially outwardly projecting piston ends 21. More specifically, the circumferential cam member 19 is inserted in recesses formed in opposite faces in the housing parts 3 and 4 with the cam member secured in position by means of the same bolts 5 as those which hold the housing parts 3 och 4 together. In accordance with the illustrated embodiment which concerns a four-cylinder internal combustion engine the cam face 20, as indicated e.g. in FIG. 4A, is essentially of elliptical configuration. However, the configuration of the cam surface may vary in dependence of the number of cylinders used.

Via a piston bolt 22, each piston 16 supports a bearing 23, which in accordance with the illustrated embodiment is a cylindrical roller bearing the outer ring 24 of which rolls in abutment against the cam face 20 in order to impart a radial motion to the pistons 16 in a direction towards the hub 11, when the rotary unit formed by the pistons 16, the cylinders 14, the hub 11, and the rive shaft 10 rotates relatively to the stationary housing 2.

In the hub 11, essentially opposite the heads 17 of the respective pistons 16, is formed an essentially radially inwardly directed through-like combustion chamber 25 having axially directed inlets and outlets 26 and 27, respectively, for intake of a combustible fuel-air mixture and exhaust of exhaust gases, respectively. In this manner, the pistons 16 are imparted a radial movement in the direction away from the hub 11 in response to the pressure increase resulting from the combustion and the centrifugal force acting on the pistons.

Figure 2B:
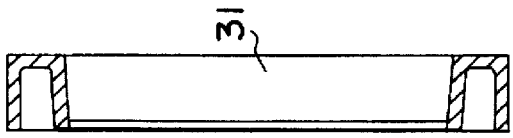
FIG. 2 is a perspective explosive view showing the various components incorporated in the valve system of FIG. 1.
Figure 2A:
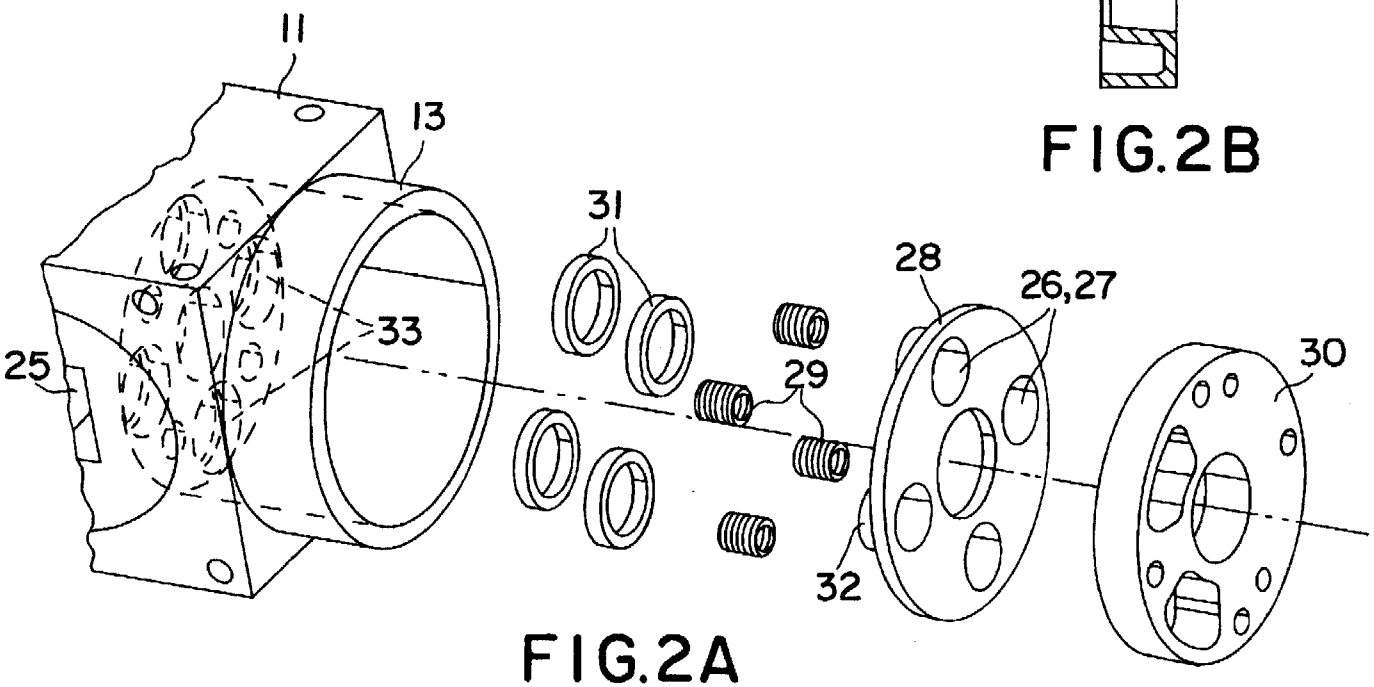
Figure 3B:
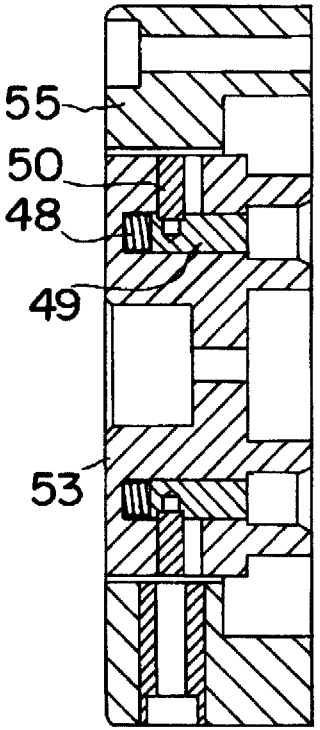
FIGS. 3A and 3B are respectively a front view and a sectional view along line 3—3 in FIG. 3A of details of an ignition system incorporated in the engine in accordance with FIG. 1.
Figure 3A:
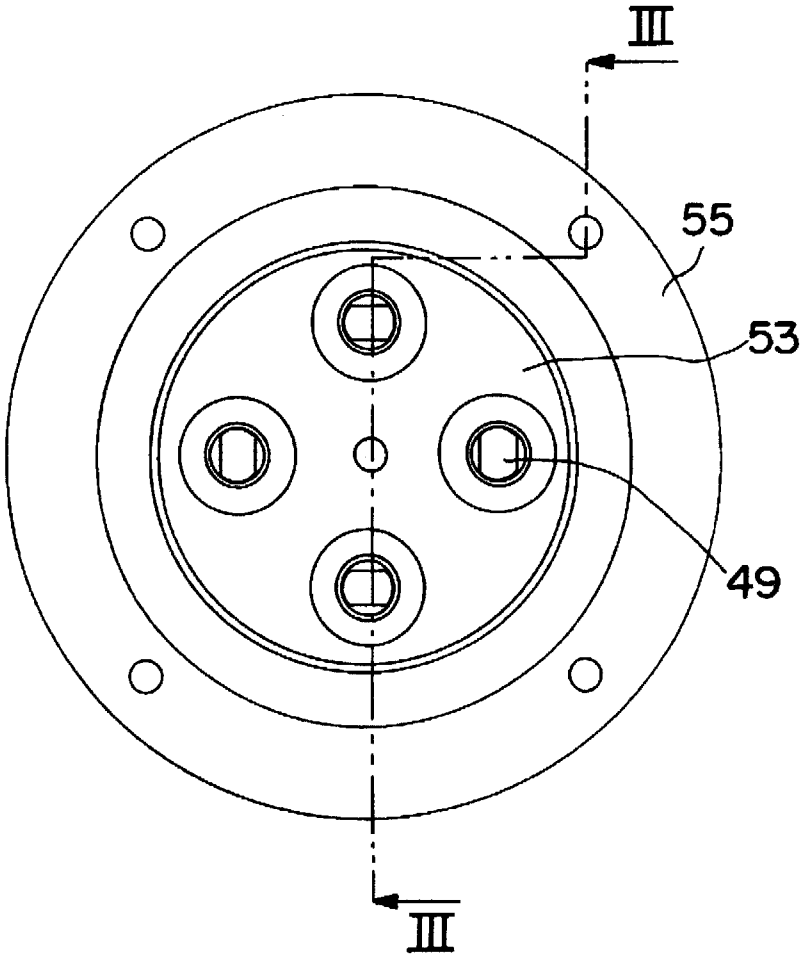

More precisely, the inlets and outlets 26, 27, leading to and from, respectively, each combustion chamber 25 are common and they are formed axially in a valve ring 28 which rotates together with the hub 11 and which is essentially concentric with the latter, see particularly FIG. 2. The valve ring 28 abuts flatly and by means of compression springs 29 it is yieldingly pressed into sealing abutment against a port ring 30 and it supports sealing rings 31 around its inlets and outlets 26, 27, respectively. In accordance with the embodiment shown the inlets and outlets 26, 27 in the valve ring 28 are prolonged axially in the form of sleeves 32 so as to extend outwardly from the valve ring 28. The sleeves 32 support the sealing rings 31 and project into corresponding recesses 33 formed in the hub 11 to ensure securement and displacement of the valve ring.

The port ring 30 is essentially concentric with the valve ring 28 and it is rigidly connected to the stationary housing 2. More precisely, by means of bolts, not shown, it is mounted on the inner end of the connection collar 8 which is turned towards the combustion chambers 25. The port ring 30 is formed with axial intake and exhaust ports 36 and 37, respectively, communicating with inlet and outlet ducts 34 and 35, respectively, in the connection collar 8. The intake and exhaust ports 36, 37 are arranged, upon rotation of the rotary unit 10, 11, 14 and 16 relatively to the stationary housing 2, alternatingly to assume a position in registry with the inlets and outlets 26 and 27 formed in the valve ring 28 and associated with their respective combustion chamber 25.

Figure 7B:
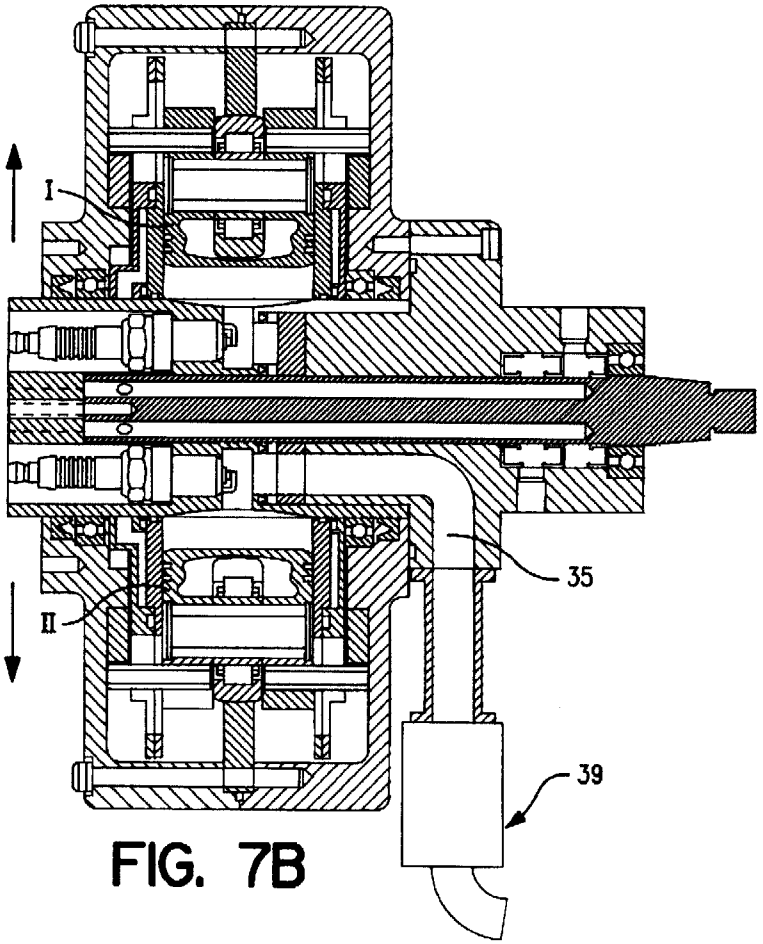

The inlet and outlet ducts 34 and 35, respectively, formed in the connection collar 8 debouch at one of their ends axially opposite the intake and exhaust ports 36 and 37, respectively, in the port ring 30 and at their opposite ends they are connected respectively to an intake system, such as a carburetter 38 or an injection system, see FIG. 1, and to an exhaust system 39, see FIG. 7B.

Intermediate the said opposite end of the inlet channel 34 and the carburetter 38 or the injection system, is an inlet pipe 40 into which debouches a channel 41 which communicates with the circumferential chamber 15 of the stationary housing 2 for the purpose of generating a negative pressure inside the chamber 15 so as to suck out any blow-by exhaust gases and, at least during conditions of low rotational speed of the engine, facilitate the radial movement outwards of the pistons 16.

For its operation, the radial-piston engine in accordance with the invention is also provided with one spark plug 46 for each combustion chamber 25, i.e. four spark plugs in accordance with the embodiment illustrated. These spark plugs are screwed essentially axially into the hub 11 at the end remote from the valve ring 28 and thus they rotate together with the hub. The electrode end of each spark plug 46 consequently projects into the associated one of the combustion chambers 25 essentially opposite the common intake and outlet 26 and 27 in the valve ring 28.

At their connective ends the spark plugs 46 are associated with an ignition distributor, generally designated by reference 47. The latter comprises electrodes 49 which are arranged to rotate together with the rotary unit 10, 11, 14, 16 and which are spring actuated by means of helical compression springs 48 into engagement with their respective on of the connective spark plug ends. Each electrode has a radially projecting contact 50 which is fastened to its associated electrode, preferably by screwing, and the contacts are arranged to sequentially move past a stationary electrode 51 which in turn is coupled to a source of ignition current, not shown in detail. Preferably, the rotating electrodes 49 and their associated contacts are disposed in recesses 52 in a hub-like holder 53 which is secured to the drive shaft 10 by means of the earlier mentioned centre bolt 12. The stationary electrode 51 is preferably arranged radially in an annular fastener 55 which is secured to the housing 2 by means of bolts 54.

To urge the pistons 16 radially outwards, at least when the internal combustion engine is started and/or operated at low rotational speeds, two circumferentially extending return cam members 56 are mounted in the circumferentially extending chamber 15 of the stationary housing 2 in accordance with the embodiment illustrated, said return cam members being positioned one on either side of the pistons 16 and radially interiorly of the cam members 19. The circumferentially extending cam members 56 have one radially outwardly facing cam face 57 each, with a configuration essentially matching that of cam face 20 on cam member 19. Two return pins 58 projecting in opposite axial directions on each piston 16 are arranged to be moved into abutment against the cam surfaces 57 of the return cam members 56 in order to, as previously mentioned, urge the pistons radially outwards while preventing them from assuming an oblique position inside their associated one of the cylinders 14.

For the sake of completeness it should be mentioned that the radial-piston engine in accordance with the invention is fitted with a water cooling system and a lubricating system but since these systems form no part of the invention as such they are not described further herein.

It should also be mentioned that the radial-piston engine is shown and described comprises four cylinders but there is nothing to prevent this number to be reduced to at least two or increased to perhaps six or more cylinders.

The mode of operation of the radial-piston engine described in the aforegoing will be described in the following with reference to FIGS. 4A–7B, and to illustrate the four-cycle sequence two of the pistons 16, designated I and II, have been chosen for the sake of simplicity.

Figure 4B:
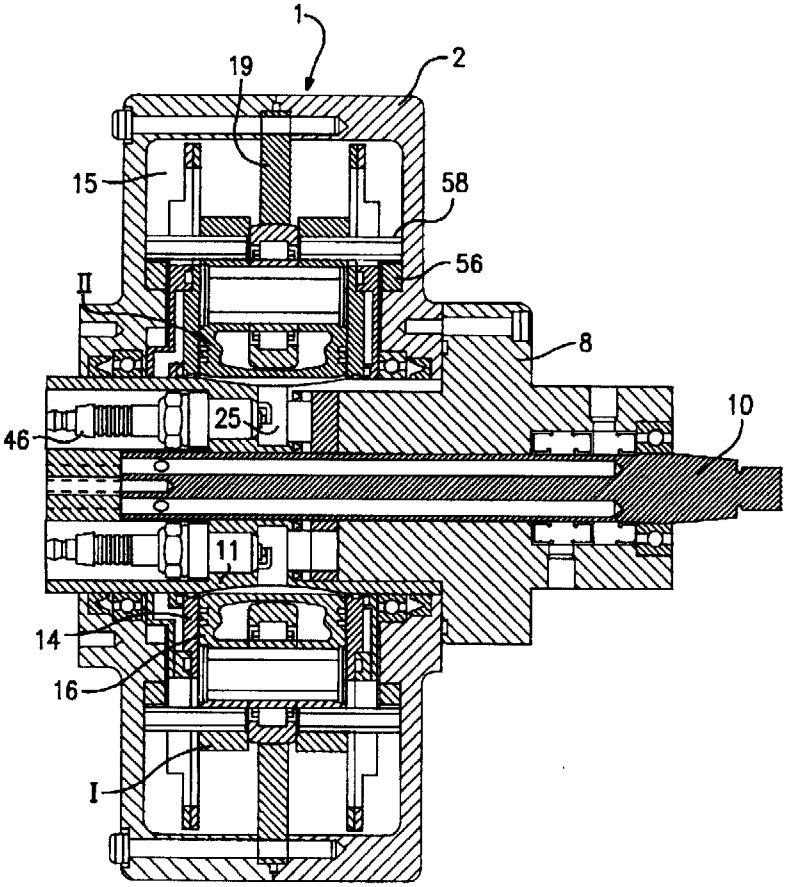
FIGS. 4A–7B are transverse and lengthwise sectional views showing the four cycles of the engine of FIG. 1 and the positions of the various components during these cycles.
Figure 4A:
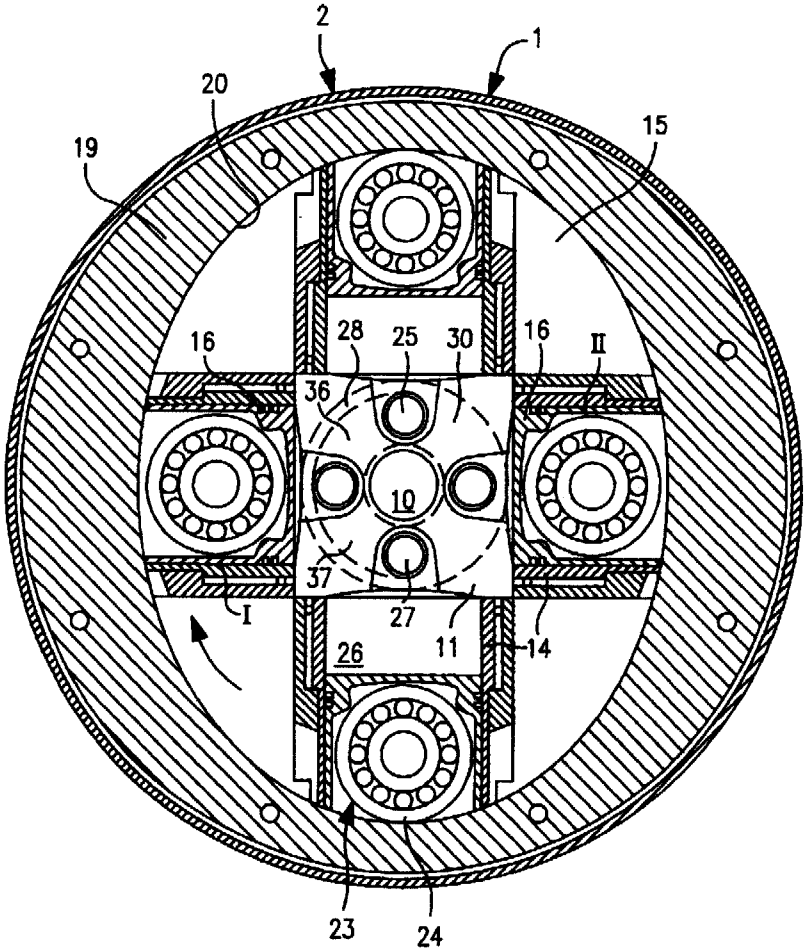

In FIGS. 4A and 4B piston I is in position to begin the suction/intake of the fuel-air mixture while piston II is in position to ignite the compressed fuel-air mixture.

Figure 5A:
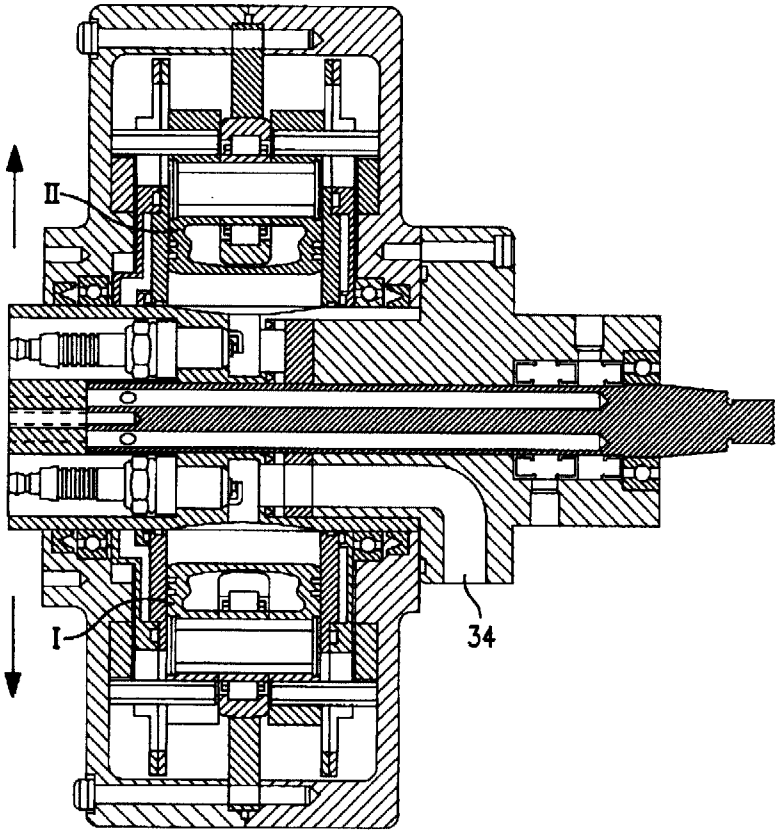
Figure 5A:
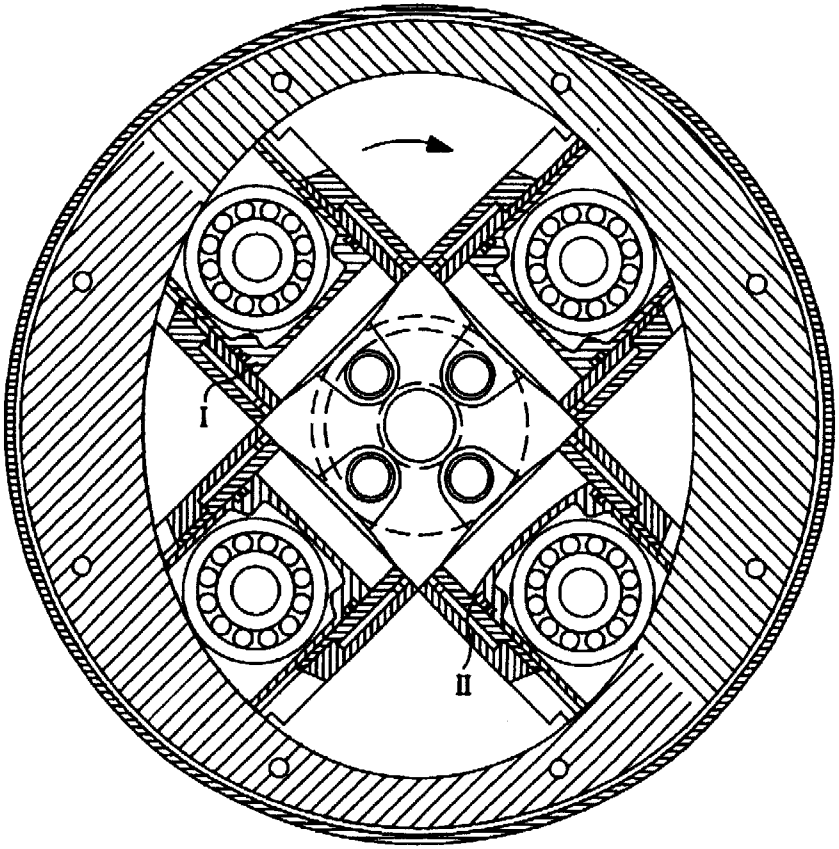

FIGS. 5A and 5B show the suction phase (suction stroke) of piston I and the expansion phase (working stroke) of piston II.

Figure 6B:
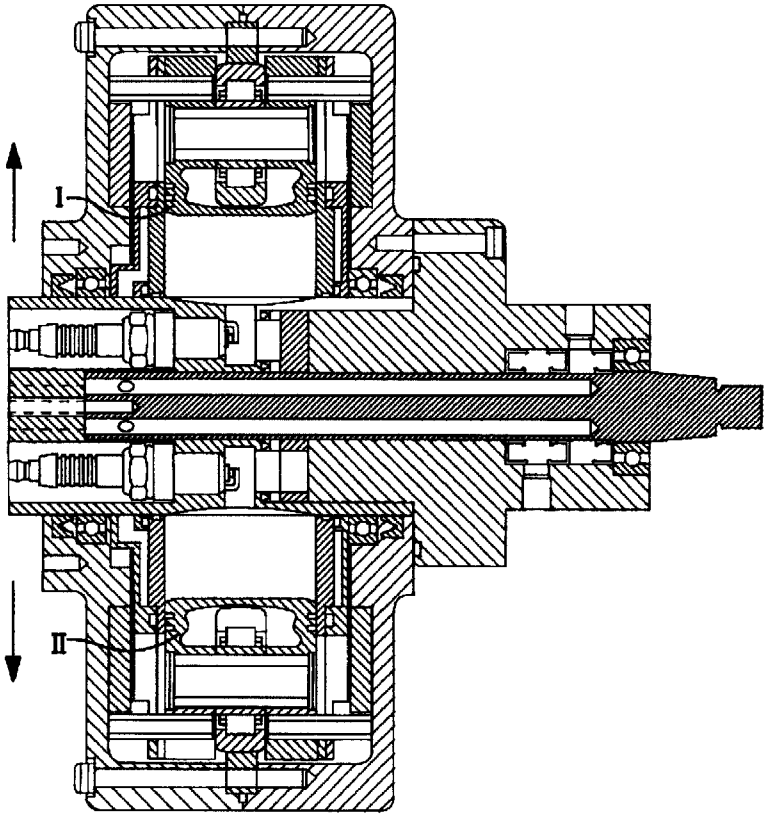
Figure 6A:
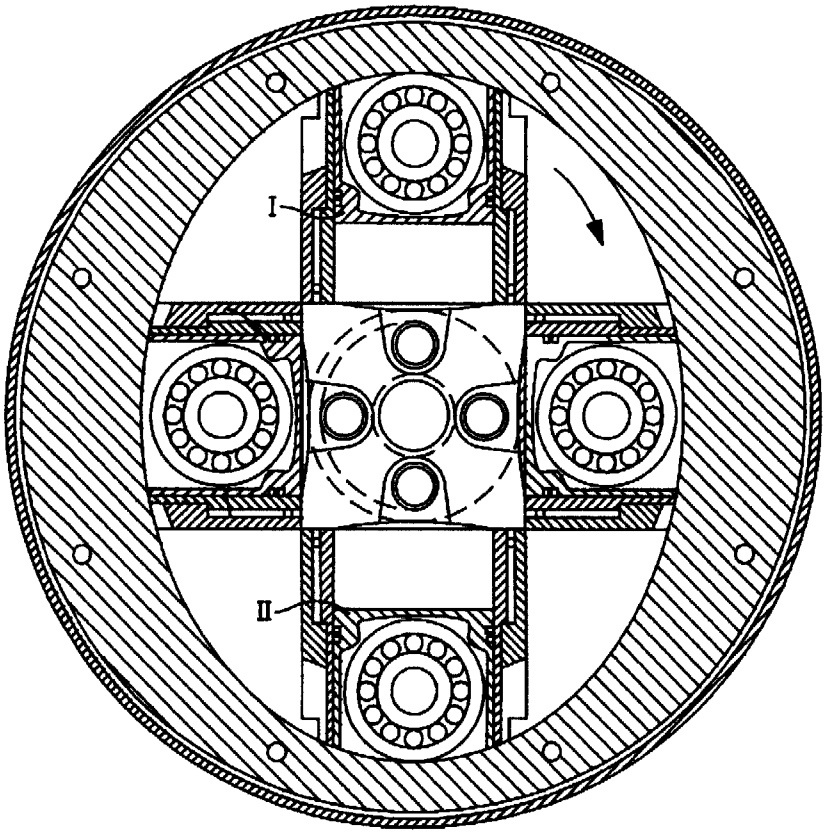

In FIGS. 6A and 6B piston I is about to begin the compression and piston II is about to begin the exhaust stroke.

Figure 7A:
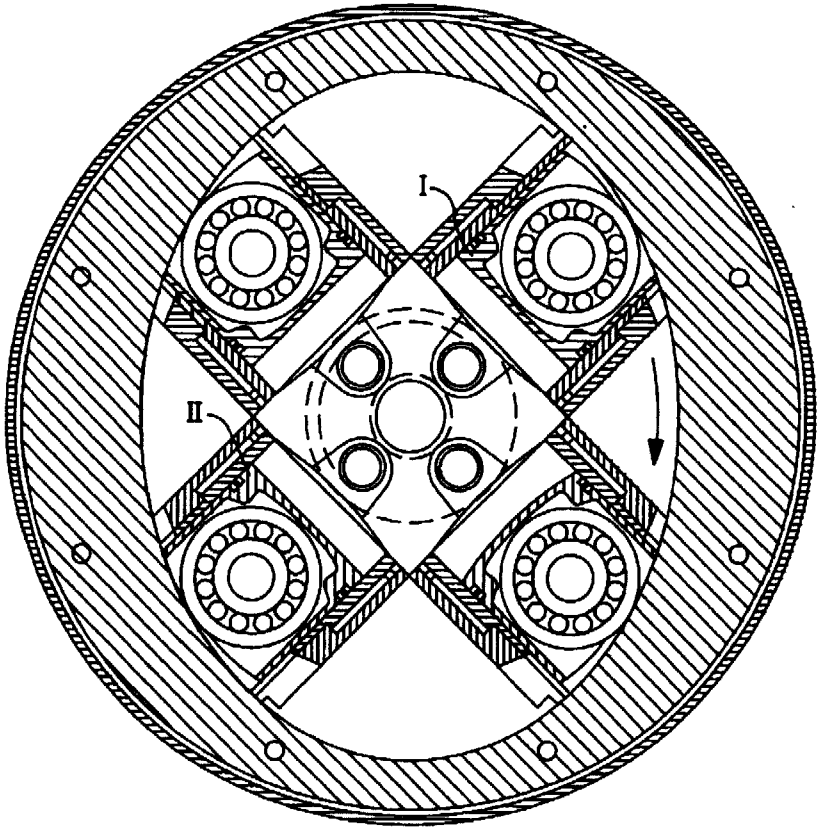

FIGS. 7A and 7B, finally, show piston I in the compression phase (compression stroke) and piston II in the exhaustion phase (exhaust stroke).

All four pistons 16 sequentially travel through all four strokes or cycles during one revolution of the rotary unit 10, 11, 14 and 16.

Figure 8C:
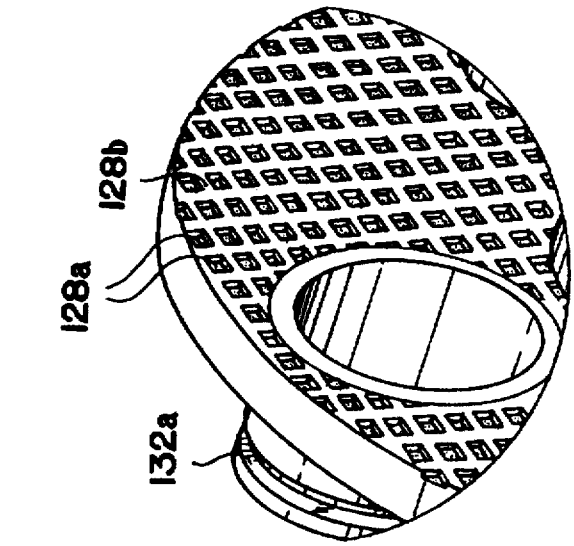
FIG. 8 illustrates in a manner corresponding to FIG. 2 a valve system in accordance with the invention in a perspective view.
Figure 8B:
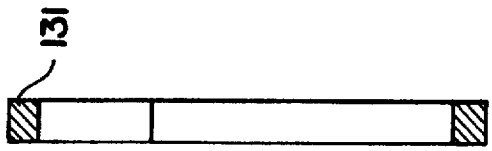
Figure 8A:
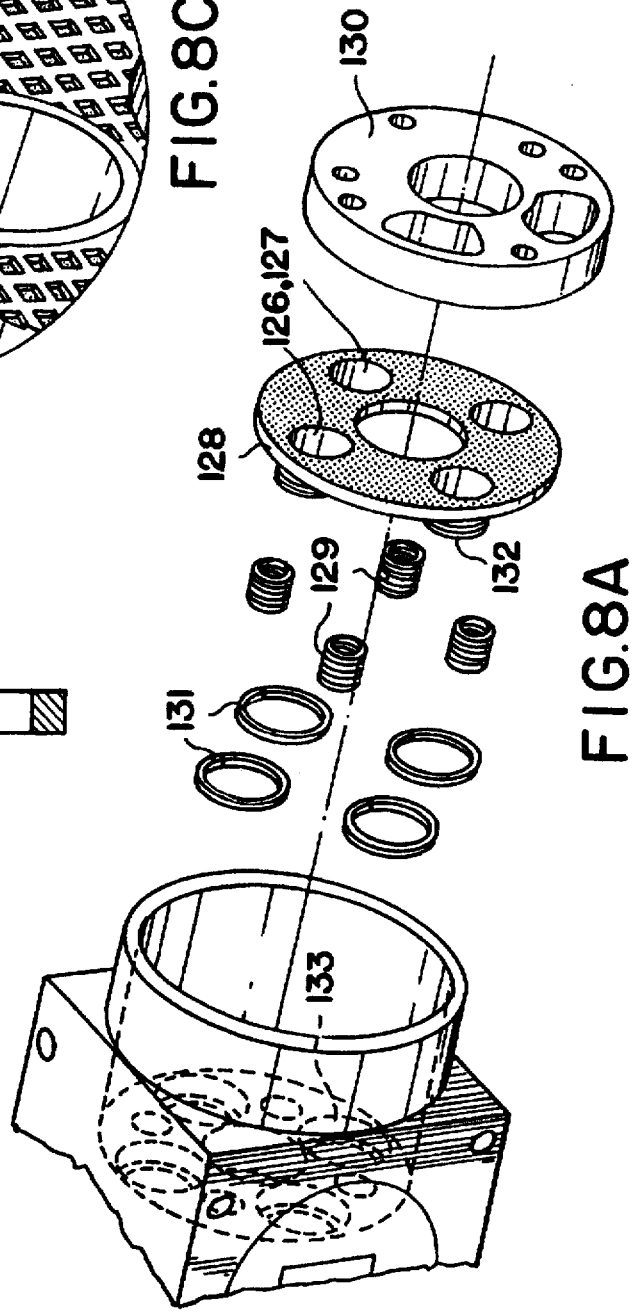

The valve system in accordance with the invention illustrated in FIG. 8 is distinguished from the valve system shown in FIG. 2 essentially in that the face of the valve ring 128 that is turned against and in sliding contact with the port ring 130 is recesses 128*a* which are distributed over the entire ring face. In accordance with the embodiment shown the recesses are arranged in a pattern of squares including rib-like protrusions 128*b* positioned intermediate the recesses and the crests of which form the valve ring plane sliding against the port ring. However, it is within the scope of the invention to configure and arrange the recesses in a different pattern. For instance, the plane-defining protrusions could be curved in an arcuate as well as in an irregular pattern. It is likewise possible to arrange the recesses, instead of in the valve ring face, also in the port ring faces, or in both the valve ring and the port ring faces. The recesses formed in the plane serve as efficient traps for any medium that tends to flow over between adjacent inlets/outlets or from the inlets/outlets to the exterior at the periphery of the port ring/valve ring. In addition, this embodiment according to FIG. 7 is distinguished from that according to FIG. 2 in that the sealing rings 131 are of an "expanding piston-ring" type and they are received in peripheral grooves 132*a* formed in the sleeve-like protrusions on the valve ring 128. Otherwise the components according to FIG. 8 corresponding to similar components in the embodiment in accordance with FIG. 2 have been given the same numeral reference with the addition of 100.

It goes without saying that the invention should not be regarded as limited to the embodiments described herein and illustrated in the drawings, which embodiments are those preferred at the moment, but that the invention could be modified in a variety of ways within the scope of the appended claims.

I claim:

1. A valve system for a radial-piston engine, comprising a stationary housing (2), a drive shaft (10) which is rotationally mounted essentially centrally inside said housing and which supports a hub (11) co-rotating therewith, at least two radially projecting cylinders (14) which are mounted on the hub to rotate therewith, said cylinders forming, together with the hub (11) and the drive shaft (10), a rotary unit arranged to rotate relative to the stationary housing (2), a combustion chamber (25) being formed in said hub (11) and having valve-operated inlets and outlets (26, 27) for intake and exhaustion, respectively, of a combustion fuel-air mixture and combusted exhaust gases, said inlets and outlets (26, 27) to and from, respectively, each combustion chamber (25) being formed axially in a valve ring (28) which co-rotates with the hub (11) and which is essentially concentric therewith, said valve ring (28) sealingly abutting against a stationary port ring (30) which is essentially concentric with the valve ring and which is connected to the housing (2), said port ring (30) being formed with axial intake and exhaust ports (36, 37) communicating with inlet and outlet ducts (34, 35), said axial intake and exhaust ports (36, 37) assuming, upon rotation of said rotary unit (10, 11, 14, 16) relative to the housing (2) a position in alignment with that inlet and outlet (26, 27) in the valve ring (28) that is associated with the respective combustion chamber (25) whereby the valve ring (28) is yieldingly pressed into abutment against said port ring (30), characterized in that at least one of the two faces in sliding contact with each other on respectively the valve ring (128) and the port ring (130) is provided with recesses (128*a*) distributed across said face.

2. A valve system in accordance with claim 1, characterized in that the recesses are arranged in a pattern including ribs positioned intermediate the recesses and forming the sliding plane of the ring.

3. A valve system in accordance with claim 1, characterized in that the recesses and the intermediate ribs are arranged in a checked pattern, wherein the ribs are essentially straight and cross one another.

4. A valve system in accordance with claim 1, characterized in that the openings formed in the valve ring and/or the port ring are entirely surrounded by sliding faces in which recesses are formed.

5. A valve system in accordance with claim 2, characterized in that the recesses and the intermediate ribs are arranged in a checked pattern, wherein the ribs are essentially straight and cross one another.

6. A valve system in accordance with claim 2, characterized in that the openings formed in the valve ring and/or the port ring are entirely surrounded by sliding faces in which recesses are formed.

7. A valve system in accordance with claim 3, characterized in that the openings formed in the valve ring and/or the port ring are entirely surrounded by sliding faces in which recesses are formed.

* * * * *